US005403210A

United States Patent [19]

Hasegawa

[11] Patent Number: 5,403,210

[45] Date of Patent: Apr. 4, 1995

[54] TERMINAL PEDESTAL

[75] Inventor: Osamu Hasegawa, Marugame, Japan

[73] Assignee: Mitsubishi Denki Kabushiki Kaisha, Tokyo, Japan

[21] Appl. No.: 199,359

[22] Filed: Feb. 18, 1994

Related U.S. Application Data

[62] Division of Ser. No. 994,309, Dec. 21, 1992, abandoned.

[30] Foreign Application Priority Data

Jun. 9, 1992 [JP] Japan ..... 4-149413

[51] Int. Cl.[6] ..... H01R 11/09

[52] U.S. Cl. ..... 439/723; 439/721

[58] Field of Search ..... 439/720, 721, 722, 723, 439/724, 709

[56] References Cited

U.S. PATENT DOCUMENTS

| | | | |
|---|---|---|---|
| 2,872,658 | 2/1959 | Batcheller | 439/723 |
| 2,924,808 | 2/1960 | Hewes et al. | 439/721 |
| 2,985,861 | 5/1961 | Rogoff et al. | 439/724 |
| 3,753,216 | 8/1973 | Johnson et al. | 439/721 |
| 5,063,314 | 11/1991 | DeSantis | 439/723 |

FOREIGN PATENT DOCUMENTS

| | | | |
|---|---|---|---|
| 57-141383 | 9/1982 | Japan . | |
| 63-160673 | 10/1988 | Japan . | |
| 0296574 | 11/1989 | Japan | 439/723 |

*Primary Examiner*—Daniel W. Howell
*Assistant Examiner*—Hien D. Vu
*Attorney, Agent, or Firm*—Burns, Doane, Swecker & Mathis

[57] ABSTRACT

Narrower connecting strips and wider connecting strips, which each has plural connecting tips and are of different widths, are fixed such that the narrower ones are superposed on the wider ones thereby making combined connecting strips, which are mounted by a rivet in each compartment provided on an insulator base. Thus desired small, medium and large numbers of the connecting tips on combined connecting strips of common electric connections are obtainable.

6 Claims, 10 Drawing Sheets

TERMINAL PEDESTAL

This application is a divisional of application Ser. No. 07/994,309, filed Dec. 21, 1992, now abandoned.

FIELD OF THE INVENTION AND RELATED ART STATEMENT

1. FIELD OF THE INVENTION

The present invention relates to a terminal pedestal which is for connecting lead wires for relaying them, for use in the electric equipment such as a control center unit.

2. DESCRIPTION OF THE RELATED ART

FIG. 7 is a plan view showing an example of the prior art terminal pedestal and FIG. 8 is a side cross-sectional view as seen from a plane cut along the line VII—VII in FIG. 7.

In FIGS.7 and 8, an insulator base 21 is press-molded integrally with partition walls 21A, thereby defining connecting compartments 22. Each of single connecting strips 23 has a U-shaped cross-section with a pair of connecting tips 29A and 29B for connecting the receiving plugs 50A and 50B of the lead wires shown in FIG. 9. The connecting strips 23 are fixed on the insulator base 21 by a caulking rivet 30.

As above-mentioned, the prior art terminal pedestal is configured by using a single U-shaped connecting strip 23 fixed alone in each compartment, and therefore only two connecting tips 29A and 29B for connecting the receiving plugs 50A and 50B of the lead wires 51 are available for each compartment 22.

The above-configured terminal pedestal of the prior art has a problem in that it cannot connect a multiplicity of lead wires in common in one connecting compartment because the number of connecting tips is small, in particular, limited to only two.

SUMMARY AND OBJECT OF THE INVENTION

The present invention is proposed in order to solve the above-mentioned problems and has as its object the provision of a terminal pedestal that can connect a multiplicity of lead wires in one connecting compartment, by employing a plurality type of the connecting strips which may have a plurality of the connecting tips for each of the connecting compartments.

According to the present invention, there is provided a terminal pedestal comprising:

an insulator base consisting essentially of a plate part, and a plurality of partition walls provided on the plate part, which are extending in lengthwise and widthwise directions of the plate part and intersecting with each other thereby defining a plurality of connecting compartments on the plate part; and two connecting strips which each have a different width and each of which are provided with a plurality of connecting tips and connected electrically and mechanically with a rivet in a superposing manner making combined connecting strips and being disposed in each of the connecting compartments.

The above-mentioned terminal pedestal may further comprises:

another plurality of partition walls provided on the back side of the plate part, which partition walls on the back side are extending in lengthwise and widthwise directions of the plate part and intersecting with each other thereby defining back side connecting compartments on the back side thereby forming substantially symmetrical connecting compartments on both sides of the plate part; and two other connecting strips, which each have different width and each of which are provided with a plurality of connecting tips and connected electrically and mechanically with the rivet in a superposing manner and being disposed in each of the back side connecting compartments, the other connecting strips being connected with the first-mentioned connecting strips through the rivets piercing through the plate part.

In the above-mentioned terminal pedestal, each of the above-mentioned other connecting strips may be disposed on each of the first-mentioned connecting compartments together with each of the first-mentioned connecting strips, and each of the connecting tips of the above-mentioned other connecting strips may thus be projected to the second-mentioned connecting compartments through the plate part.

Alternatively, each of the second-mentioned connecting strips may be disposed in each of the second-mentioned connecting compartments in a substantially symmetrical manner with each of the first-mentioned connecting strips.

In the above-mentioned terminal pedestal, the connecting strips are preferably fixed on the plate part by caulking rivets, and the insulator base may be formed integrally with the plate part and the partition walls.

In the above-mentioned terminal pedestal, at least one of the plurality of partition walls is provided with a display strip on its top face.

As above-mentioned, the terminal pedestal of the present invention is configured by accommodating the U-shaped connecting strips of various types (e.g. twin-type, triple type, etc.) for their connecting tips, for each of the connecting compartment. Therefore, the available number of the connecting tips can be made sufficient for connecting a multiplicity of lead wires in one connecting compartment, and the connecting compartments can arbitrary be selected in compliance with the number of the connecting tips.

Further, when the display strips are provided on the top faces of the partition walls, one of the connecting compartments can be distinguished clearly from the others. Thereby the workability in a connecting operation may be much improved.

While the novel features of the present invention are set forth particularly in the appended claims, the invention, both as to organization and content, will be better understood and appreciated, along with other objects and features thereof, from the following detailed description taken in conjunction with the appended drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

[Example 1]

Figure 1:
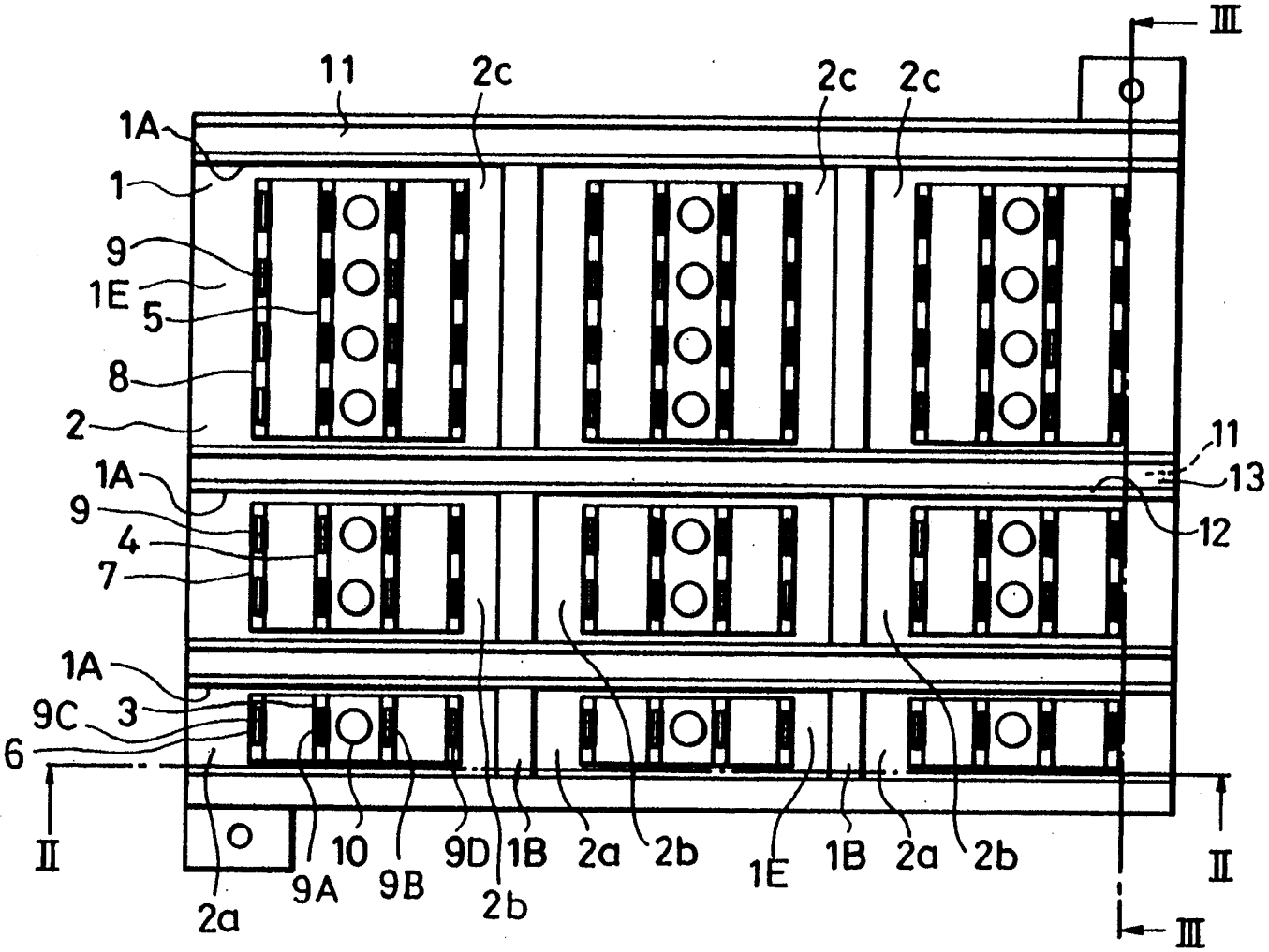
FIG. 1 is a plan view showing a terminal pedestal built in accordance with one embodiment of the present invention.

In the following paragraphs, a first embodiment of the present invention will be described with reference to FIG. 1, FIG. 2 and FIG. 3. In these figures, an insulator base 1 comprises a plate part 1E integrally pressmolded with partition walls 1A and 1B. The lengthwise and widthwise partition walls 1A and 1B are extending in lengthwise and widthwise directions in checkerboard fashion and intersecting with each other, respectively, thereby defining a plurality of connecting compartments 2*a*, 2*b*, 2*c*.

In each of the connecting compartments 2*a*, 2*b*, 2*c*, there are provided one of narrower U-shaped connecting strips 3, 4 or 5, and one of the other wider U-shaped connecting strips 6, 7 or 8, both being secured on the insulator base 1 with caulking rivets 10. The wider U-shaped connecting strips 6, 7 or 8 have a larger width than that of the narrower U-shaped connecting strips 3, 4 or 5 and the latter 3, 4 or 5 are superimposed on the former ones 6, 7 or 8, respectively. As shown in FIG. 1, the connecting strips 3 and 6 each have two connecting tips 9A and tips 9B, and 9C and 9D for connecting the lead wires, respectively. Thus, in the first row of FIG. 1, each of the connecting compartments 2*a* accommodates a total of four connecting tips 9. In the second row of FIG. 1, each of the narrower and wider connecting strips 4 and 7 has four connecting tips 9 for connecting the lead wires, and therefore each of the connecting compartments 2*b* accommodates a total of eight connecting tips 9. In the third row of FIG. 1, each of the narrower and wider connecting strips 5 and 8 has eight connecting tips 9 for connecting the lead wires, and therefore each of the connecting compartments 2*c* accommodates a total of sixteen connecting tips 9. The caulking rivets 10 also serve electrically and mechanically to connect the narrower connecting strip 3 with the wider connecting strip 6, the narrower connecting strip 4 with the wider connecting strip 7, and the narrower connecting strip 5 with the wider connecting strip 8, respectively.

On each of the top faces of the lengthwise extending partition walls 1A, there is engraved a groove 12. And therein, each display strip 11 for indicating the type or function of each connecting compartments is embedded, and thereon a cover 13 for protecting the display strip is embedded.

The terminal pedestal configured as mentioned above can connect a multiplicity of the lead wires in common, by providing a multiplicity of combinations of the narrower and wider connecting strips 3 and 6, or 4 and 7, or 5 and 8 which are connected to each other, each having a plurality of connecting tips thereon. Further, by providing a plurality of different numbers of the connecting tips 9 accommodated in each of the rows of connecting compartments, such as, four in the connecting compartments 2*a*, eight in the connecting compartments 2*b* and sixteen in the connecting compartments 2*c*, it is possible to selectively use desired connecting compartments depending upon the number of the necessary connecting tips 9.

In addition to the above-mentioned, as a result of providing the display strips 11 on the top walls of the partition walls 1A, differentiation of the connecting compartments is easy, and thus the workability of the terminal pedestal in applications requiring the connecting of a multiplicity of lead wires is improved.

Figure 4:
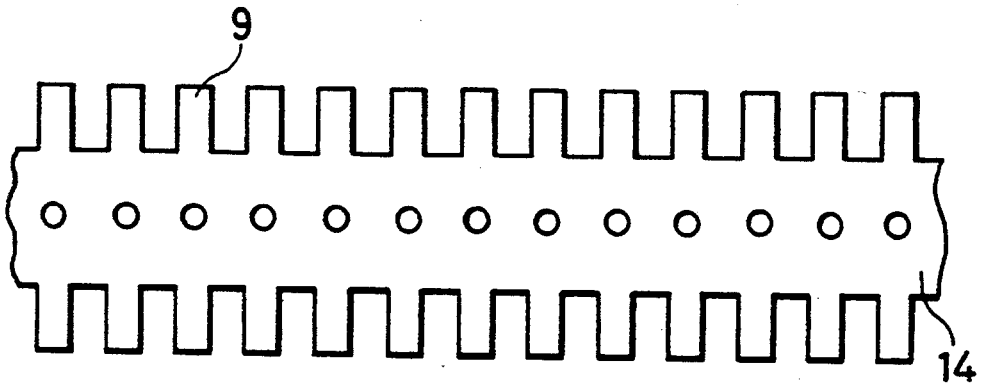
FIG. 4 is a plan view of the connecting strips connected continuously and developed for illustration.

Moreover, various types of the connecting strips are easily produced, because they can be manufactured by merely dividing (cutting) continuously aligned strips 14 as shown by FIG. 4 into desired lengths for the individual strips.

Figure 2:
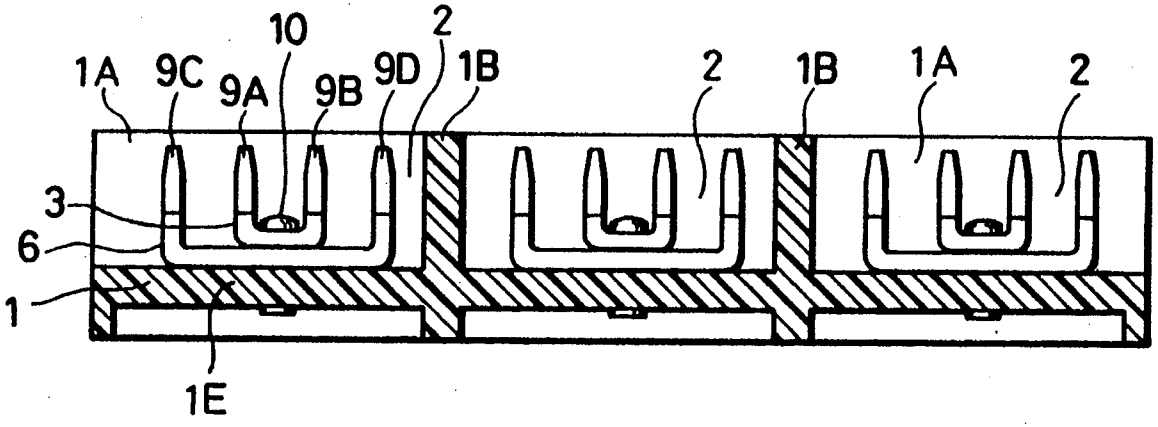
FIG. 2 is a front cross-sectional view as seen from a plane cut along the line II—II in FIG. 1.
Figure 2A:
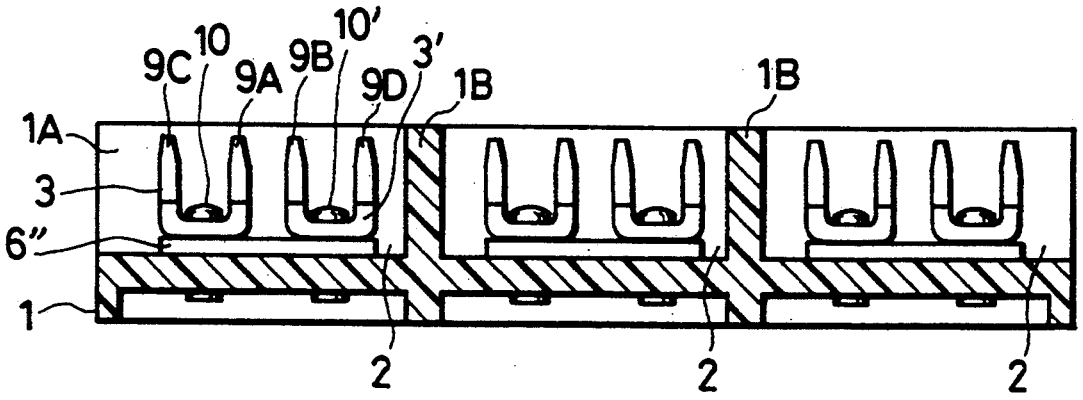
FIG. 2A is a front cross-sectional view showing a terminal pedestal built in accordance with an embodiment which is a modified form of the example of FIG. 2.
Figure 3:
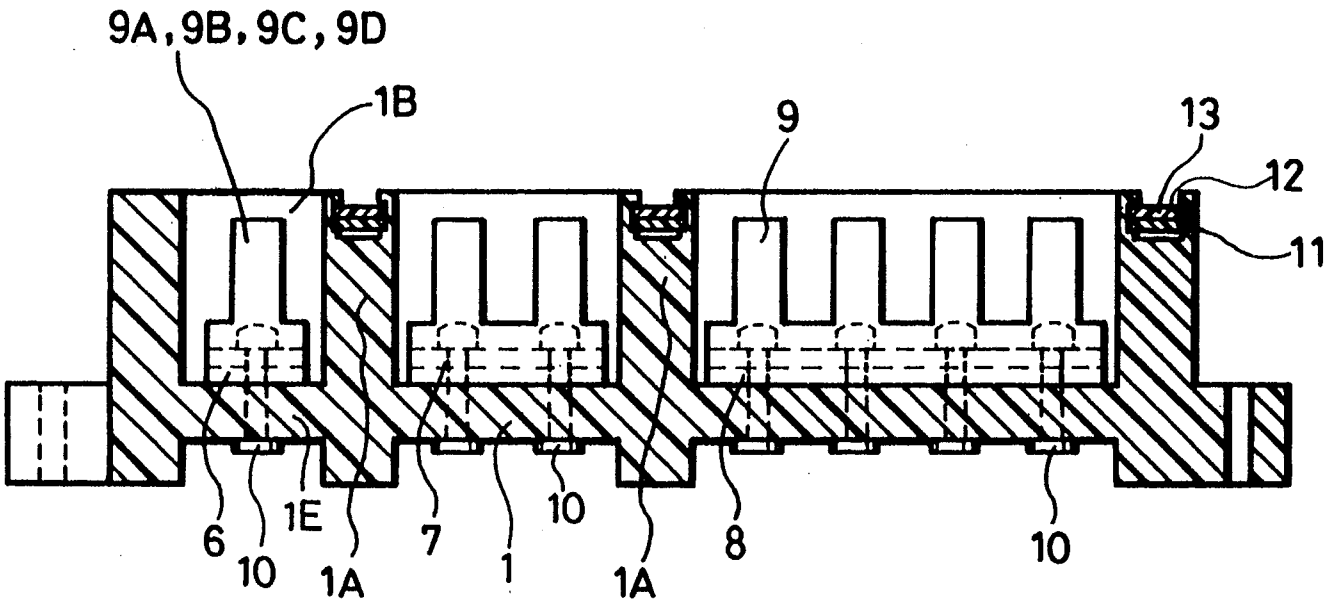
FIG. 3 is a side cross-sectional view as seen from a plane cut along the line III—III in FIG. 1.

FIG. 2A is an example further modified from the example of FIG. 2. In this example, connecting tips 9A and 9C are made in a first integral body, while connecting tips 9B and 9D are made in a second integral body. And these two integral bodies of the same shape are connected to a common base metal sheet 6″ by caulking rivets 10 and 10′.

[Example 2]

Figure 5:
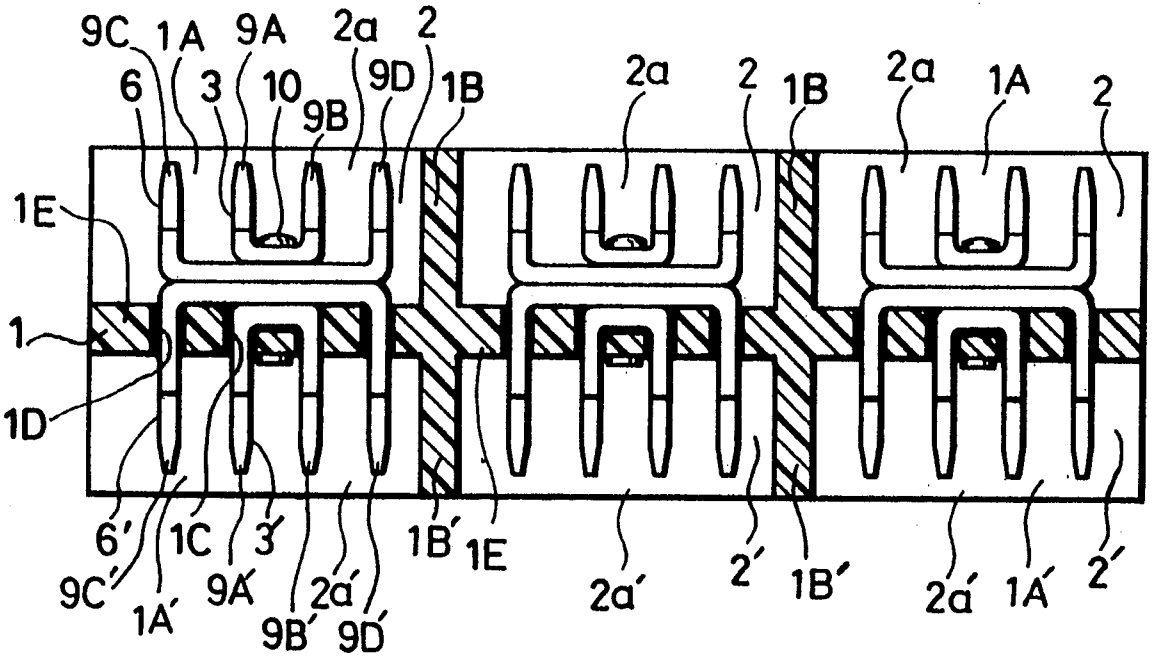
FIG. 5 is a front cross-sectional view showing a terminal pedestal built in accordance with another embodiment of the present invention.

Another embodiment of the present invention is illustrated in a cross-sectional view of FIG. 5. The plan view of this embodiment is the same as that of the Example 1 and thus omitted here for brevity.

In this embodiment, the partition walls 1A and 1B are provided extending below beyond the plate part 1E of the insulator base 1 further to the back side thereof, thereby forming the back side partition walls 1A′ and 1B′ and defining another plurality of back side connecting compartments 2*a*′, 2*b*′, 2*c*′ on the back side face of the plate part 1E of the insulator base 1.

In each of the connecting compartments, the plate part 1E of the insulator base 1 is provided with through holes 1C and 1D. The back side wider connecting strips 6′ are disposed beneath the wider connecting strips 6, and the back side narrower connecting strips 3′ are similarly placed beneath the narrower connecting strips 6′, in a back to back fashion. Then, all of the connecting strips 3, 6, 3′ and 6′ accommodated in the first-mentioned connecting compartments 2*a*, 2*b*, 2*c* are vertically connected together and mounted on the insulator base 1 in skewering manner by a caulking rivets 10. The connecting tips 9A′, 9B′, 9C′ and 9D′ of the back side connecting strips 3′ and 6′ are projected downward to the back side connecting compartments 2*b*′ via the through holes 1C and 1D bored on the plate part of the insulator base 1, respectively.

Although not illustrated in the drawing, in the connecting compartments arranged parallel with the row of the compartments illustrated in FIG. 5, the connecting strips at both front and back sides are fixed on the plate part of the insulator base 1.

In this embodiment, the number of the connecting tips available for connecting with the lead wires is doubled as compared with the foregoing embodiment.

Figure 5A:
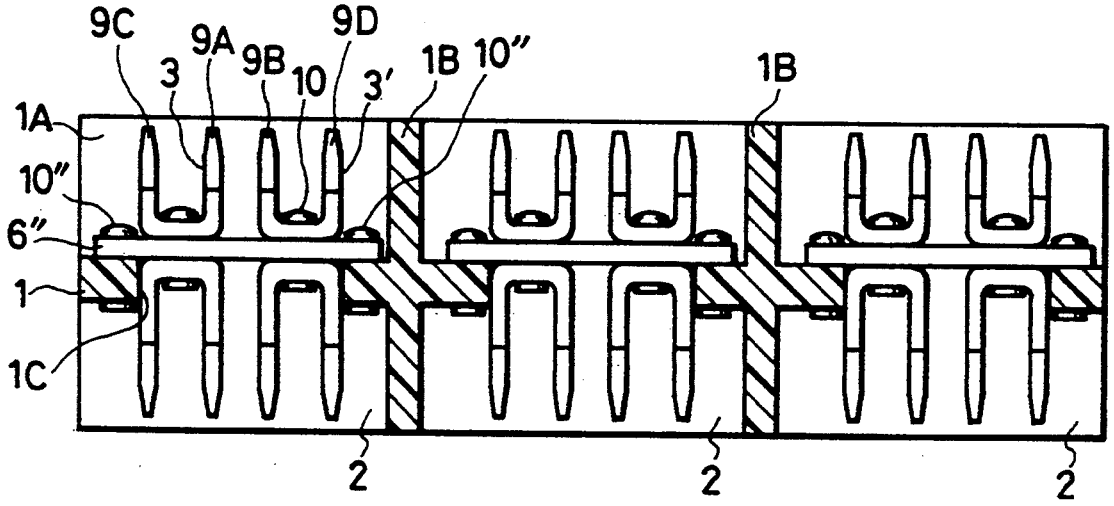
FIG. 5A is a front cross-sectional view showing a terminal pedestal of still another embodiment modified from the example of FIG. 5.

FIG. 5A shows an example further modified from the example of FIG. 5. In this example, upper connecting tips 9A and 9C are made in a first integral body, while upper connecting tips 9B and 9D are made in a second integral body. Besides the lower connecting tips are also made similarly in lower integral bodies. And the upper and lower integral bodies of the same shape are connected on the upper face and lower face of a common base metal sheet 6'' by caulking rivets 10 and 10' in symmetry to the base metal sheet 6''. The base metal sheet 6'' is fixed by caulking rivets 10'' to the insulator base 1 having large through holes 1C for disposing the fixed base parts of the lower integral bodies therethrough.

[Example 3]

Figure 6:
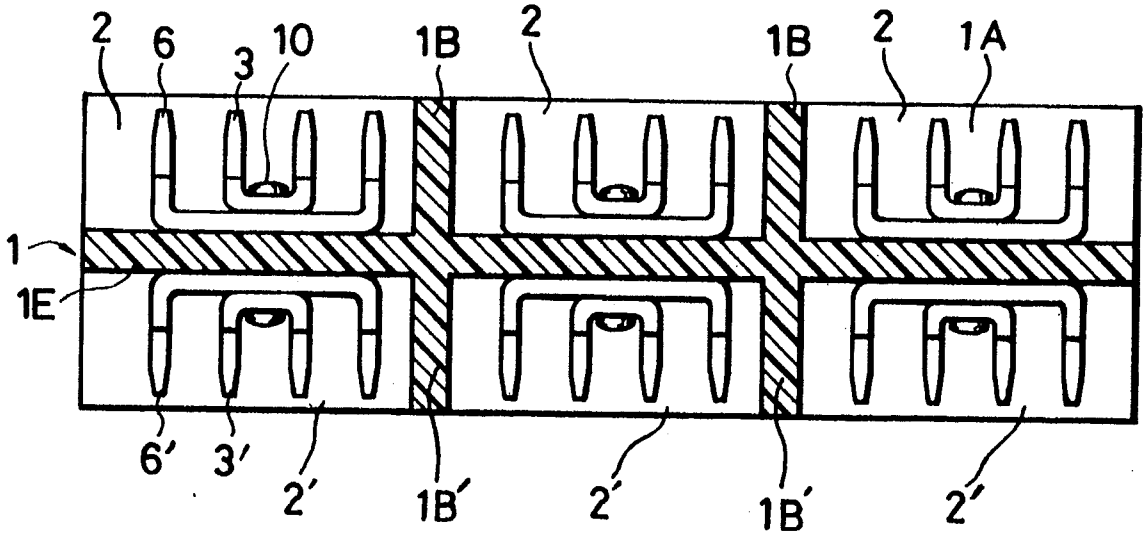
FIG. 6 is a front cross-sectional view showing a terminal pedestal built in accordance with a further embodiment of the present invention.
Figure 7:
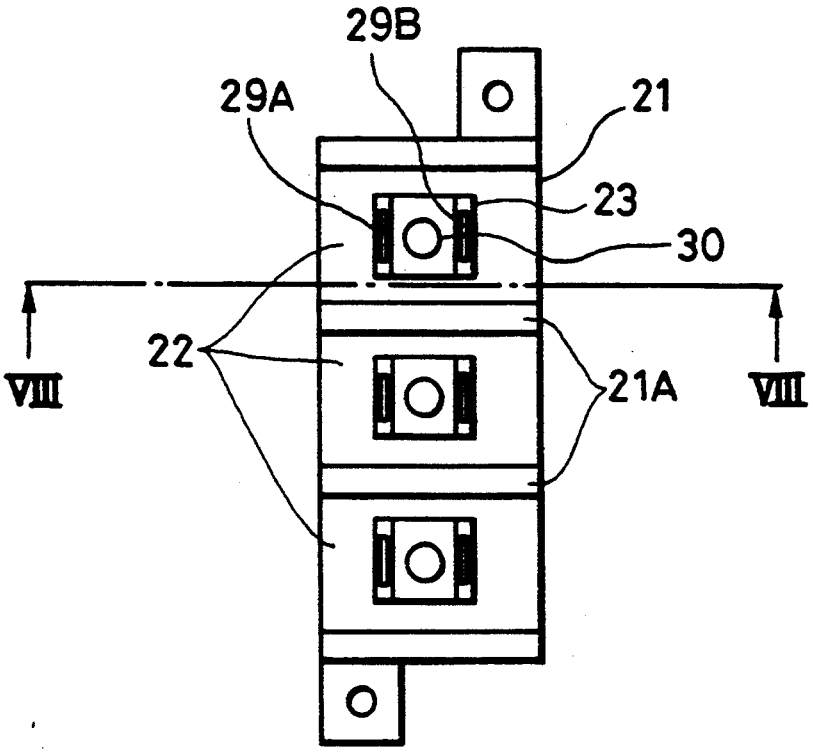
FIG. 7 (Prior Art)
FIG. 7 is a plan view showing an example of the prior art terminal pedestal.
Figure 8:
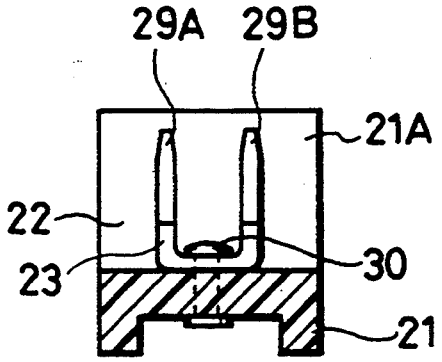
FIG. 8 (Prior Art)
FIG. 8 is a front cross-sectional view showing the terminal pedestal shown in FIG. 7.
Figure 9:
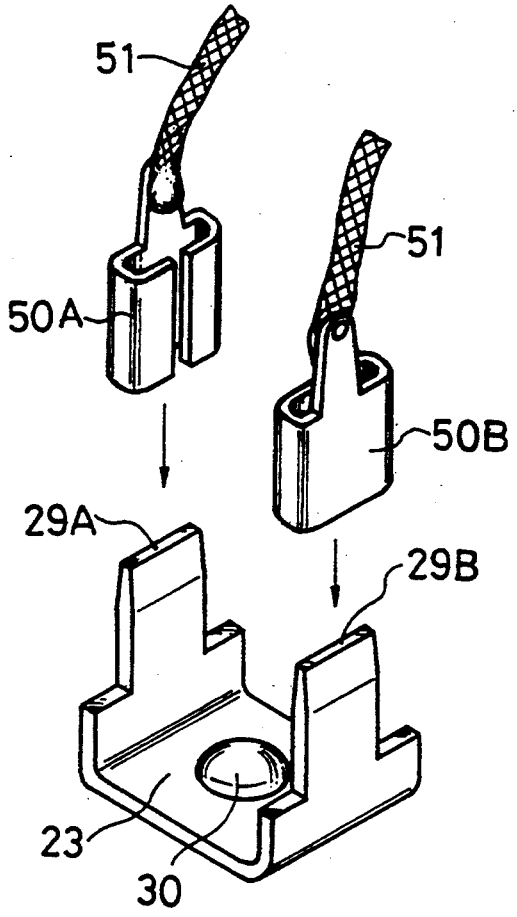
FIG. 9 is a perspective view showing the way of connecting wires to the connecting tips.

A further embodiment of the present invention is illustrated in a cross-sectional view of FIG. 6. The plan view of this embodiment is the same as that of the Example 1 and thus omitted here for brevity.

As in the foregoing Example 2, the partition walls 1A and 1B are extending below beyond the insulator base 1 further to the back side, thereby forming the back side partition walls 1A' and 1B' and defining another plurality of back side connecting compartments 2' on the back side face of the insulator base 1.

In contrast to the terminal pedestal of Example 2, the whole parts of the connecting strips 3' and 6' disposed in the back side connecting compartment 2' and the counterpart connecting strips 3 and 6 in the front side connecting compartment 2 are disposed in substantially the symmetrical fashion with respect to the insulator base 1, respectively. All of the connecting strips 3, 6, 3' and 6' are mounted and fixed on the insulator base 1 together by a caulking rivets 10. As a result of the rivet-caulking, the connecting strips 3, 6, 3' and 6' are electrically connected for performing the same function as that of the Example 2.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is

1. A terminal pedestal comprising:

an insulator base consisting essentially of a plate part, and a plurality of partition walls provided on said plate part, which extend in lengthwise and widthwise direction of said plate part and intersect each other thereby defining rows and columns, wherein each of said rows comprises a plurality of connecting compartments on said plate part;

each of said compartments containing two first connecting strips having different lengths compared with the first connecting strips contained in adjacent compartments of the same row;

the two first connecting strips each having a different width and each being provided with a plurality of connecting tips;

a rivet for connecting said two first connecting strips electrically and mechanically to one another in superposing manner and disposed in each of said connecting compartments;

another plurality of partition walls provided on a back side of said plate part, which partition walls on the back side extend in lengthwise and widthwise directions of said plate pan and intersect each other thereby defining rows and columns, wherein each of said rows comprises back side connecting compartments on said back side thereby forming substantially symmetrical connecting compartments on both sides of said plate part;

each of said back side compartments containing two second connecting strips having different lengths compared with the second connecting strips contained in adjacent back side compartments of the same row; and said two second connecting strips rich having a different width and each being provided with a plurality of connecting tips;

said connecting said two second connecting strips to one another electrically and mechanically, in superposing manner; and said two second connecting strips being electrically connected with said two first connecting strips through said rivet piercing through said plate part.

2. A terminal pedestal in accordance with claim 1, wherein;

base parts of said two second connecting strips are disposed in each of said connecting compartments together with the first connecting strips, and each of said connecting tips of said second connecting strips is projected to said back side connecting compartments through said plate part.

3. A terminal pedestal in accordance with claim 1, wherein;

each of said second connecting strips is disposed in each of said back side connecting compartments in a substantially symmetrical manner with each of the first connecting strips.

4. A terminal pedestal in accordance with claim 1, 2 or 3, wherein said connecting strips are fixed on said plate part by caulking

5. A terminal pedestal in accordance with claim 1, 2 or 3, wherein said insulator base is an integral mold with said plate part and said partition walls.

6. A terminal pedestal in accordance with claim 1, 2 or 3, wherein at least one of said plurality of partition walls is provided with a display strip on its top face.

* * * * *